US009341043B2

(12) United States Patent
Bailey et al.

(10) Patent No.: US 9,341,043 B2
(45) Date of Patent: May 17, 2016

(54) SEAL ELEMENT GUIDE

(71) Applicant: WEATHERFORD TECHNOLOGY HOLDINGS, LLC, Houston, TX (US)

(72) Inventors: Thomas F. Bailey, Abilene, TX (US); James W. Chambers, Hackett, AR (US)

(73) Assignee: Weatherford Technology Holdings, LLC, Houston, TX (US)

( * ) Notice: Subject to any disclaimer, the term of this patent is extended or adjusted under 35 U.S.C. 154(b) by 140 days.

(21) Appl. No.: 13/926,571

(22) Filed: Jun. 25, 2013

(65) Prior Publication Data

US 2013/0341052 A1 Dec. 26, 2013

Related U.S. Application Data

(60) Provisional application No. 61/663,797, filed on Jun. 25, 2012.

(51) Int. Cl.
*E21B 33/08* (2006.01)

(52) U.S. Cl.
CPC ..... *E21B 33/085* (2013.01)

(58) Field of Classification Search
CPC ..... E21B 33/085
See application file for complete search history.

(56) References Cited

U.S. PATENT DOCUMENTS

| | | | | |
|---|---|---|---|---|
| 2,222,082 | A | 11/1940 | Leman et al. | |
| 2,929,610 | A | 3/1960 | Stratton | |
| 5,662,181 | A | 9/1997 | Williams et al. | |
| 6,138,774 | A | 10/2000 | Bourgoyne, Jr. et al. | |
| 6,263,982 | B1 | 7/2001 | Hannegan et al. | |
| 6,910,531 | B2 | 6/2005 | Smith, Jr. | |
| 7,159,669 | B2 | 1/2007 | Bourgoyne et al. | |
| 7,174,956 | B2 | 2/2007 | Williams et al. | |
| 7,237,618 | B2 | 7/2007 | Williams | |
| 7,240,727 | B2 | 7/2007 | Williams | |
| 7,926,593 | B2 | 4/2011 | Bailey et al. | |
| 2003/0221519 | A1 * | 12/2003 | Haugen | 81/57.15 |
| 2008/0060846 | A1 * | 3/2008 | Belcher et al. | 175/25 |
| 2010/0175882 | A1 | 7/2010 | Bailey et al. | |

OTHER PUBLICATIONS

Agnes Wittmann-Regis, International Preliminary Report on Patentability, Feb. 10, 2015, 10 pages, The International Bureau of WIPO, Geneva, Switzerland.

* cited by examiner

*Primary Examiner* — Catherine Loikith

(74) *Attorney, Agent, or Firm* — Smith IP Services, P.C.

(57) ABSTRACT

A pressure control apparatus and methodology related to a drilling operation has a housing such as, for example, a bearing assembly configured to engage an item of oilfield equipment being delivered through the oilfield pressure control apparatus. The housing has an upper and/or a lower portion with a seal element coupled to the upper and/or lower portion and configured to seal around the item of oilfield equipment. A guide is coupled proximate the seal element. The guide is configured to support and/or limit lateral deflection of the seal element during the lateral deflection of the seal element created by movement of the item of oilfield equipment.

6 Claims, 12 Drawing Sheets

SEAL ELEMENT GUIDE

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A "SEQUENCE LISTING", A TABLE, OR A COMPUTER PROGRAM LISTING APPENDIX

Not applicable.

BACKGROUND

Technical Field

This disclosure relates to the field of oilfield equipment and operations. Oilfield operations may be performed in order to extract fluids from the earth. When a well site is completed, pressure control equipment may be placed near the surface of the earth including in a subsea environment. The pressure control equipment may control the pressure in the wellbore while drilling, completing and producing the wellbore. The pressure control equipment may include blowout preventers (BOP), rotating control devices, and the like.

The rotating control device or RCD is a drill-through device with a rotating seal that contacts and seals against the drill string (drill pipe, casing, drill collars, kelly, etc.) for the purposes of controlling the pressure or fluid flow to the surface. The RCD may have multiple seal assemblies and, as part of a seal assembly, may have two or more seal elements in the form of stripper rubbers for engaging the drill string and controlling pressure up and/or downstream from the stripper rubbers. For reference to existing descriptions of rotating control devices and/or for controlling pressure please see U.S. Pat. Nos. 5,662,181; 6,138,774; 6,263,982; 7,159,669; and 7,926,593 the disclosures of which are hereby incorporated by reference.

The seal elements in the RCD or other pressure control equipment have a tendency to wear out quickly. For example, tool joints passing through the sealing element may cause failure in the sealing element via stresses eventually causing fatigue and/or chunks of seal material tearing out of the sealing element. In high pressure, and/or high temperature wells the need is greater for a more robust and efficiently designed seal element and/or seal holder.

The RCD may have two or more seal elements which may be stripper rubbers, or seal elements. One seal element may be at an inlet to the RCD and exposed to a riser above the RCD. A second or lower seal element may be located below the first seal element and may be exposed to the wellbore pressure from below. This lower seal element may seal the wellbore pressure in the wellbore. The lower seal element is typically supported only at its upper end. Thus, the seal element extends below the support for engagement with the drill string and/or downhole tool as the drill string and/or downhole tool is run into and out of the wellbore.

As the drill string is run into, and/or out of the RCD, this movement may have certain effects that could enhance the risk of failure to a sealing element. The lateral and axial movement (upward or downward) will cause deformation and wear on the seal elements. The lower seal element may also be deformed laterally by, for example, misalignment in the drill string as it is run into and/or out of the wellbore. This deformation may wear out the lower seal element at a faster rate than the upper seal element. There is a need for an improved RCD for reducing the wear on the seal elements in the RCD.

BRIEF SUMMARY OF THE EMBODIMENT(S)

A pressure control apparatus and methodology related to a drilling operation for use on land, in a marine environment (above water or below water on the floor for the body of water), or for directional drilling under an obstacle has a housing such as, for example, a bearing assembly configured to engage an item of oilfield equipment being delivered through the oilfield pressure control apparatus. The housing has an upper and/or a lower portion with a seal element coupled to the upper and/or lower portion and configured to seal around the item of oilfield equipment. A guide is coupled proximate the seal element. The guide is configured to support and/or limit lateral deflection of the seal element during the lateral deflection of the seal element created by movement of the item of oilfield equipment.

As used herein the term "RCD" or "RCDs" and the phrase "pressure control apparatus" or "pressure control device(s)" shall refer to pressure control apparatus/device(s) including, but not limited to, blow-out-preventer(s) (BOPs), and rotating-control-device(s) (RCDs).

As used herein the terms "radial", "radially", "lateral" or "laterally" include directions outward away from the drill string, tubular, tool joint or item of oilfield equipment. Such directions include those perpendicular and transverse to the center axial direction of the drill string, tubular, tool joint or item of oilfield equipment, yet off-center, moving outwardly away from a position concentric with the longitudinal axis of the interior region of the RCD the drill string, tubular, tool joint or item of oilfield equipment.

DETAILED DESCRIPTION OF EMBODIMENT(S)

Figure 1A:
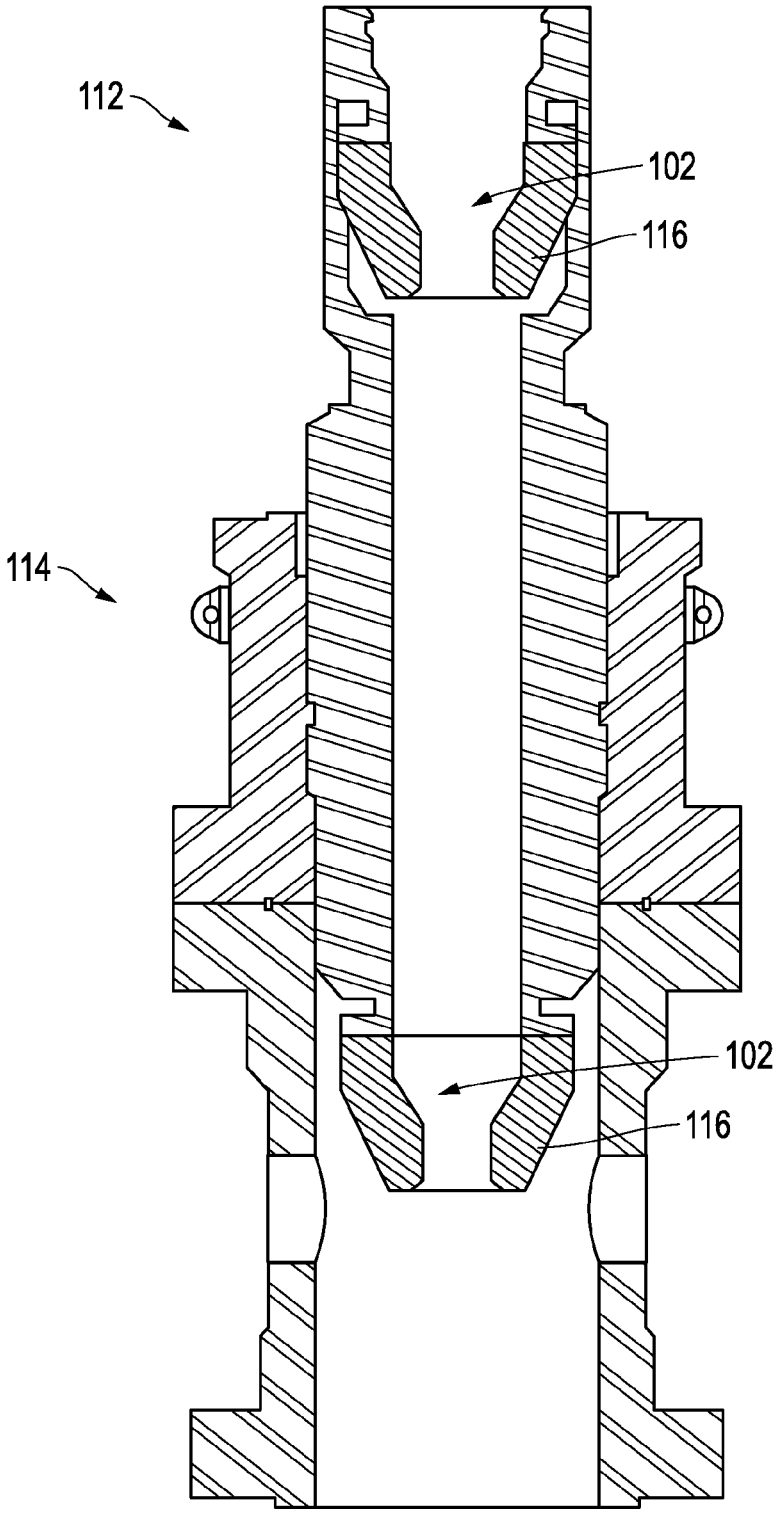
FIG. 1A depicts a cross-sectional view of an RCD showing a seal element without a guide.
Figure 1B:
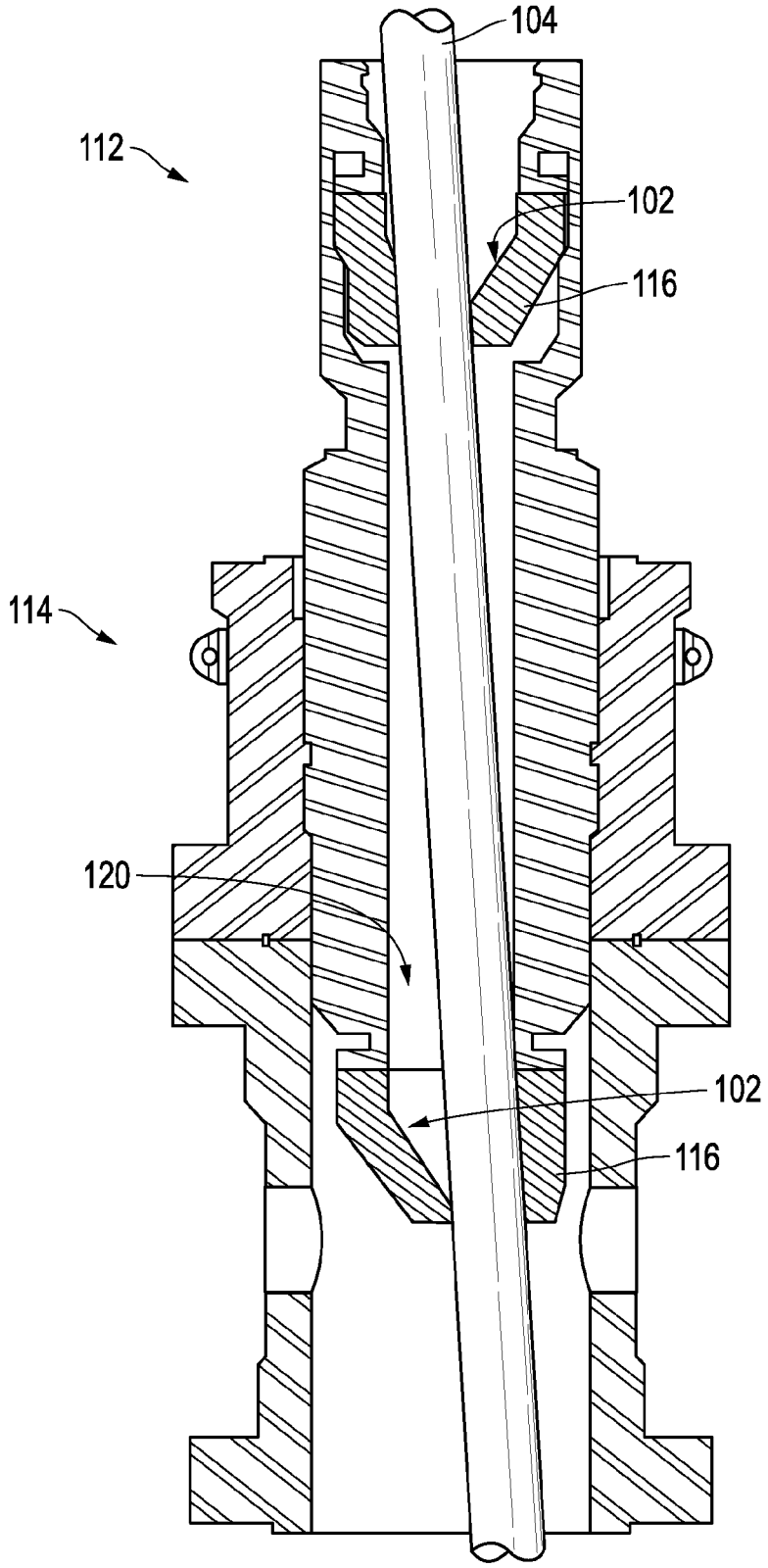
FIG. 1B depicts a cross-sectional view of an RCD showing a seal element without a guide and an item of oilfield equipment in a state of misalignment within the RCD.

FIGS. 1A and 1B depict a view of a pressure control apparatus/device 112 without the guide 118 improvements (to be further described herein). Pressure control apparatus/devices 112 may include, but are not limited to, BOPs, RCDs 114, and the like. The pressure control apparatus/device 112 has one or more seal elements 102 for sealing an item of oilfield equipment 104 (see FIG. 1B) at a wellsite proximate a wellbore (or in a marine environment above and/or below the water; or for directional drilling under an obstacle) formed in the earth and lined with a casing. The one or more pressure control devices 112 may control pressure in the wellbore. The seal elements 102 are shown and described herein as being located in an RCD 114 (rotational control device). The one or more seal elements 102 may be one or more annular stripper rubbers 116, or seal elements 102, located within the RCD 114. The seal elements 102 may be configured to engage and seal the oilfield equipment 104 during oilfield operations. The oilfield equipment 104 may be any suitable equipment to be sealed by the sealing element 102 including, but not limited to, a drill string, a tool joint, a bushing, a bearing, a bearing assembly, a test plug, a snubbing adaptor, a docking sleeve, a sleeve, sealing elements, a tubular, a drill pipe, a tool joint, or even non-oilfield pieces of equipment such as for directional drilling under obstacles and the like. Referring to FIG. 1B, the RCD 114 without the guide 118 improvements is represented in a state of misalignment due to the item of oilfield equipment 104 (e.g. a tubular) being non-concentric with and not parallel to the longitudinal axis 236 (i.e. misaligned across the interior region 120) of the RCD 114. Such a state of misalignment may occur in a RCD 114 situated on land and in a RCD situated offshore (or below water). Due to this state of misalignment and as further compounded by movement of the misaligned item of oilfield equipment 104 against the seal elements 102, such seal elements 102, and more particularly the lower seal element 102, is/are exposed to damage.

The description that follows includes exemplary apparatus, methods, techniques, and instruction sequences that embody techniques of the inventive subject matter. However, it is understood that the described embodiments may be practiced without these specific details.

Figure 2A:
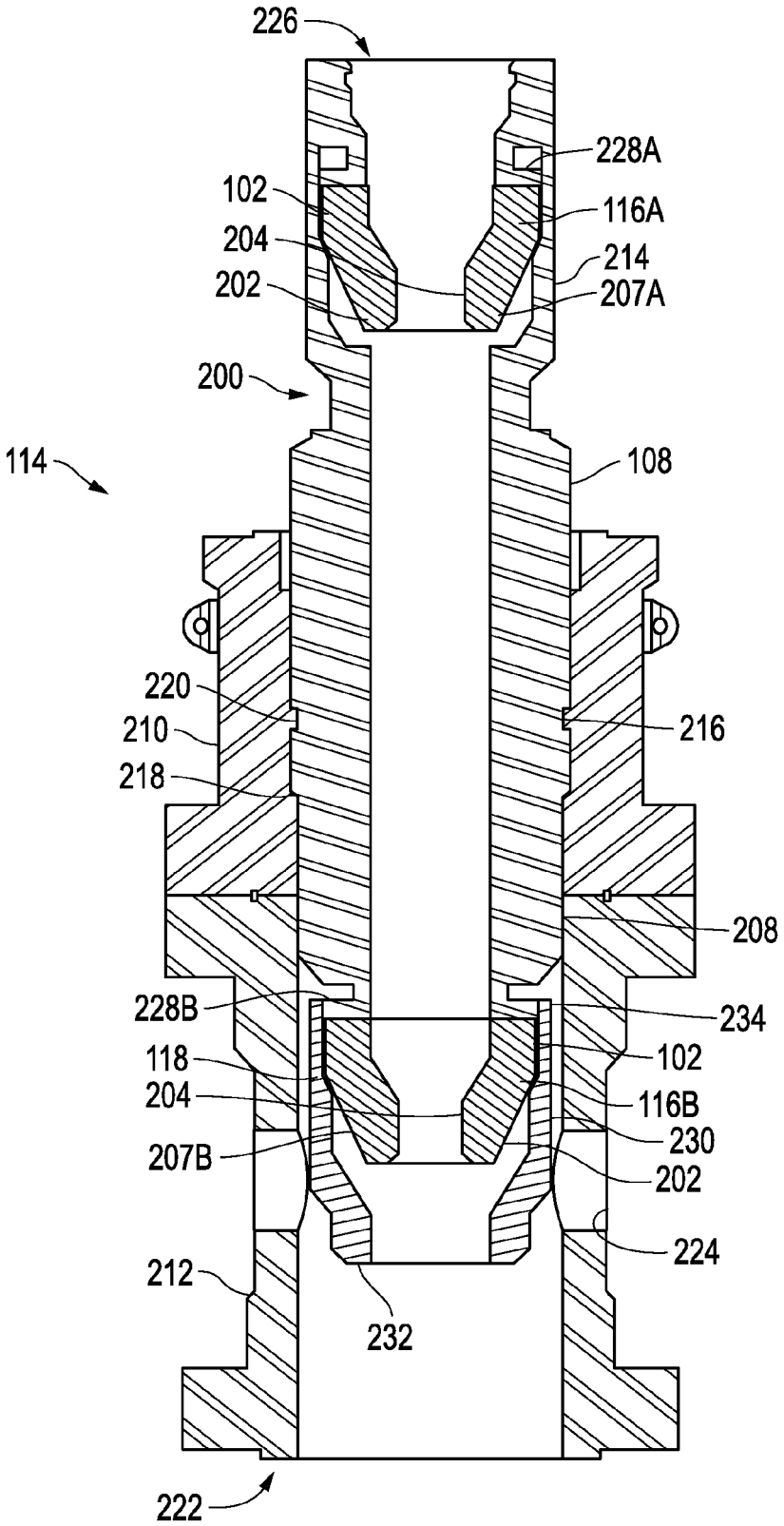
FIG. 2A depicts a cross-sectional view of an RCD according to an embodiment.
Figure 2B:
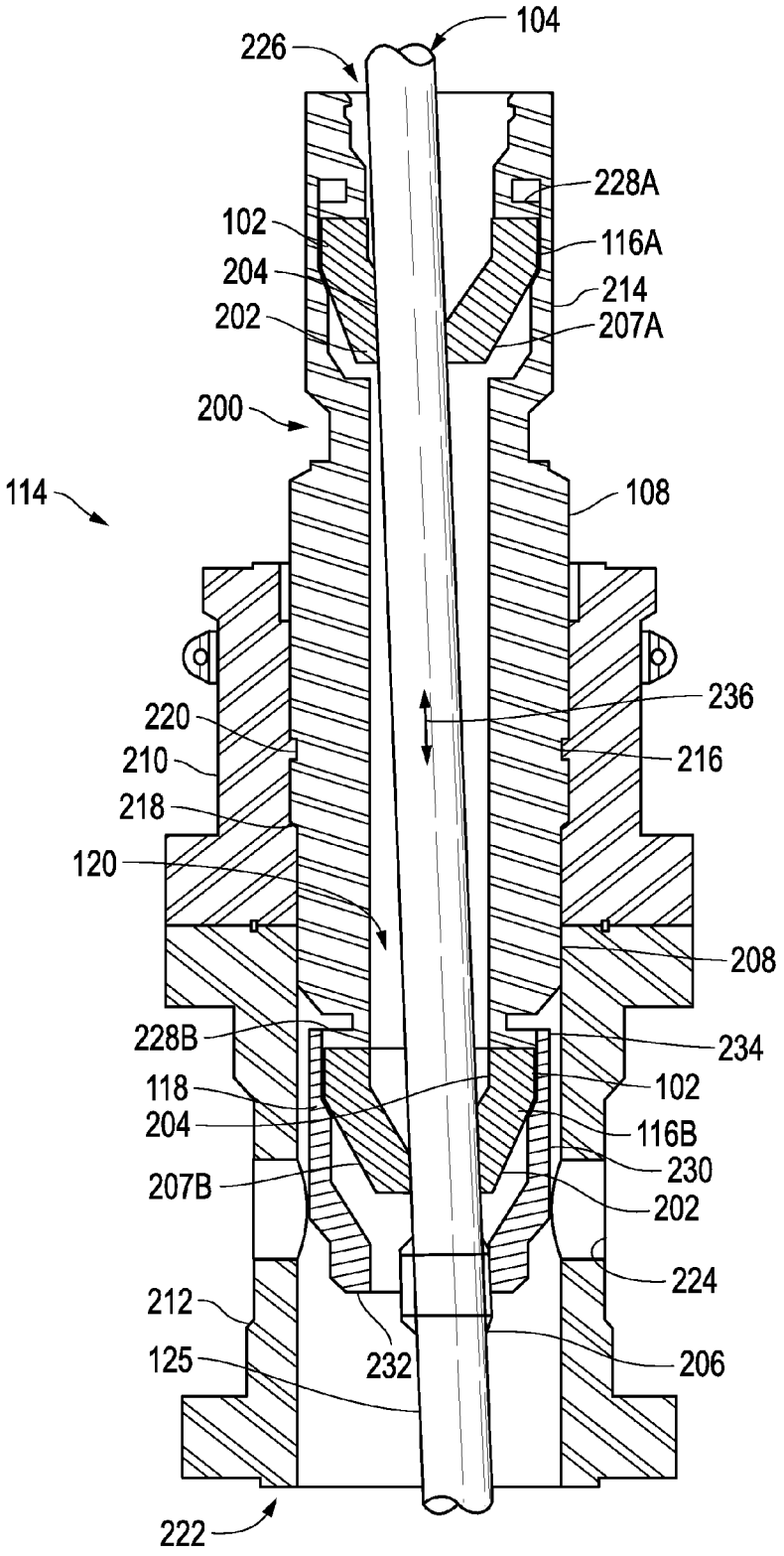
FIG. 2B depicts the embodiment of FIG. 2A with the addition that it represents an item of oilfield equipment in a state of misalignment within the RCD.

FIGS. 2A and 2B depict a cross sectional schematic view of the RCD 114 according to an embodiment. In this embodiment the seal elements 102 may have a guide 118 configured to reduce the deformation and/or wear on the seal element 102 from engagement with the item of oilfield equipment 104. FIG. 2B represents the RCD 114 in a state of misalignment due to the item of oilfield equipment 104 (e.g. a tubular) being misaligned across the interior region 120 of the RCD 114. The RCD 114 as shown has a seal assembly 200 with at least two seal elements 102 in the form of stripper rubbers 116. The stripper rubbers 116 are placed in an upper-lower relationship such that there is an upper stripper rubber 116A and a lower stripper rubber 116B. The stripper rubbers 116 seal against the tubular 125 and/or item of oilfield equipment/tool joint 104 (in certain instances below, for sake of brevity, reference to item(s) of oilfield equipment 104 may collectively refer to item(s) of oilfield equipment 104, tool joints 206 and tubulars 125) when the pressure is greater on an exterior side 202, or outer surface, of the stripper rubber 116 as compared to the pressure on an interior side 204 of the stripper rubber 116. As the tubular 125 passes through the RCD 114, larger diameter tool joints 206 may pass through the RCD 114. The large diameter tool joints 206 may deform a portion of the stripper rubber 116A and/or 116B. For example, the large diameter tool joints 206 may radially expand a nose 207A and 207B of the respective stripper rubbers 116A and 116B.

Figure 7:
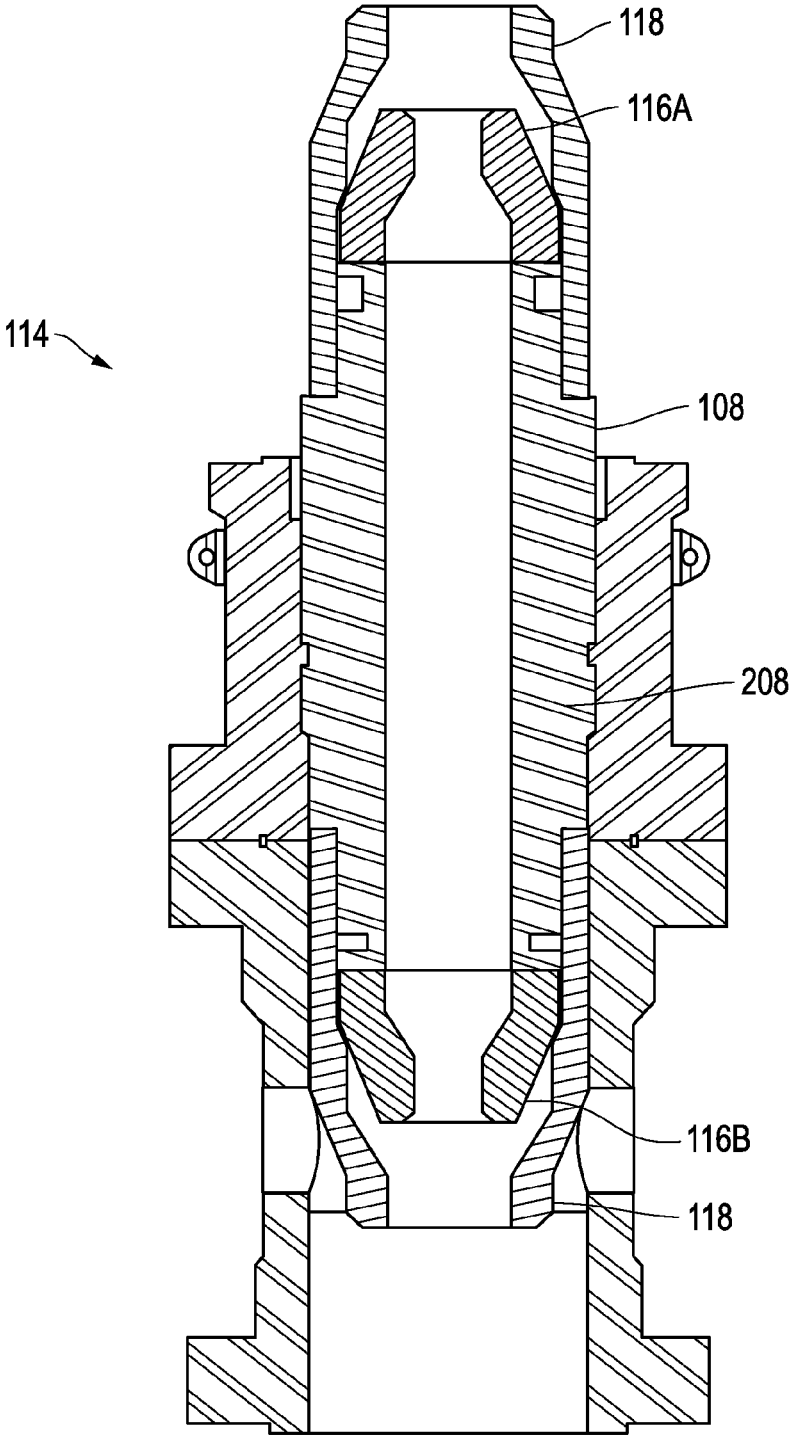
FIG. 7 depicts another embodiment wherein the guide is mounted above the housing or bearing assembly.

The RCD 114 as shown in FIGS. 2A and 2B has a housing 108 which is not limited to, but in one embodiment is a bearing assembly 208, the upper stripper rubber 116A, the lower stripper rubber 116B, an upper housing 210, a lower housing 212, a carrier 214, and the guide 118 (note that the guide 118 is largely discussed below with relation to the lower stripper rubber 116B but it is equally intended to be applicable with relation to the upper stripper rubber 116A in another embodiment, as represented in FIG. 7, but is often not specified below for sake of brevity only). The housing 108 may be configured to guide and/or rotate with the oilfield equipment 104 as the oilfield equipment 104 is run into and/or out of the wellbore 106 (as shown in FIG. 1). The housing 108 in the embodiment shown is coupled to the upper stripper rubber 116A and the lower stripper rubber 116B. As the oilfield equipment 104 is rotated in the RCD 114, in the case where the housing 108 is a bearing assembly 208 the upper and lower stripper rubbers 116A and 116B and the bearing assembly 208 may rotate with the oilfield equipment 104. This rotation may reduce the wear on the stripper rubbers 116A and 116B.

The bearing assembly 208, as shown in FIGS. 2A and 2B, may be secured to the upper housing 210. The bearing assembly 208 may be fixed longitudinally relative to the upper housing 210, while being free to rotate relative to the upper housing 210. For example, one or more upsets 216 and/or shoulders 218 may be implemented. As shown, the upset 216 is an annular upset for engaging a profile 220 on the bearing assembly 208, although any suitable device may be used including, but not limited to, locking dogs, a c-ring, and the like. The upper housing 210 may bear the lateral loads from the items oilfield equipment 104 engaging the bearing assembly 208 while allowing the bearing assembly 208 and thereby the seal assembly 200 to rotate with the bearing assembly 208.

The upper housing 210 may secure, or be integral with the lower housing 212. The lower housing 212 may have a connector 222 for securing the RCD 114 to other equipment including, but not limited to, the or other pressure control devices 112 (as shown in FIG. 1). The lower housing 212 may have one or more ports 224 configured to pump fluids (e.g. drilling fluids) into and/or out of the RCD 114 below the lower stripper rubber 116B. The one or more ports 224 may allow the operator and/or a controller, as known to one of ordinary skill in the art, to control the annular pressure below the stripper rubber 116B.

The upper stripper rubber 116A may be coupled to and partially supported by the carrier 214. The carrier 214 may be integral with, or coupled to, the bearing assembly 208. The carrier 214 may have an open end 226 for receiving and guiding the oilfield equipment 104 into the RCD 114. The carrier 214 may have an upper seal coupler 228A configured to couple the stripper rubber 116A, or any other suitable seal, to the carrier 214. The seal coupler 228A may be any suitable device for coupling the stripper rubber 116A to the carrier 214 including, but not limited to, one or more fasteners, an engagement ring, an adhesive, any combination thereof, and the like. Although, the RCD 114 is shown having the upper stripper rubber 116A and the carrier 214, it should be appreciated that the upper stripper rubber 116A is optional. Further, the upper stripper rubber 116A may be oriented in a position inverted to a position as shown wherein the nose 207A points toward the open end 226 of the carrier 214.

The lower stripper rubber 116B may be connected to the bearing assembly 208 via a lower seal coupler 228B. The lower seal coupler 228B may couple to the lower stripper rubber 116B using any suitable device including, but not limited to, those described for the upper seal coupler 228A. The lower seal coupler 228B suspends the lower stripper rubber 116B below the bearing assembly 208 so that the nose 207B of the lower stripper rubber 116B is pointed in a downhole direction.

The guide 118 may surround, brace and direct the lower stripper rubber 116B as the item of oilfield equipment 104 passes through the pressure control device 112 and becomes contiguous with the lower stripper rubber 116B. The guide 118 functions as a support (i.e. a backing brace), guide and/or limit as to the lateral travel of the item(s) of oilfield equipment 104 and/or the lower stripper rubber 116B. The guide 118 may have a seal bracing portion 230, an equipment bracing portion 232 and a guide connector portion 234. The guide 118 is preferably made of metal including, but not limited to, steel and carburized steel, or a composite material, although other materials providing rigid support may be implemented. The guide 118 may include a surface treatment such as in a coating, atomic layer deposition, electro-polishing or the like. The guide 118 may include a separable and replaceable liner (not shown).

The seal bracing portion 230 may be configured, initially concentric with, and laterally surrounding the lower stripper rubber 116B and thereby limit the lateral movement of the lower stripper rubber 116B. Therefore, if a larger diameter portion 206 of the item of oilfield equipment 104 engages the lower stripper rubber 116B and/or the oilfield equipment 104 becomes longitudinally misaligned in (or non-concentric with) the RCD 114, the seal bracing portion 230 would be contiguous with the lower stripper rubber 116B and may be engaged by the lower stripper rubber 116B in the event that the lateral travel is sufficiently great enough to allow same (e.g. a lateral travel distance of less than the travel distance to the inner diameter of the bearing assembly 208). This engagement would limit or bound the lateral deformation of the lower stripper rubber 116B.

The equipment bracing portion 232 may be configured, initially concentric with the desired axial travel position of the item of oilfield equipment 104 as the oilfield equipment is run into or out of the wellbore 106 (as shown in FIG. 1). Accordingly, the guide 118 and its equipment bracing portion 232 function as a guide, for load sharing, to protect the exterior surface of the piece of oilfield equipment 104, and yet cannot interfere with the function of the stripper rubber 116A/B. Referring to FIG. 2B as the item of oilfield equipment 104 is run into or out of the wellbore 106, the oilfield equipment 104 may become misaligned across the interior region 120 (or non-concentric with and not parallel to a longitudinal axis 236) of the RCD 114. Without the guide 118, the misalignment of the oilfield equipment 104 could push the lower stripper rubber 116B radially away from its centered position about the longitudinal axis 236. With the guide 118, the item of oilfield equipment 104 may only travel a sufficiently shorter distance radially away from the longitudinal axis 236 (e.g. a lateral travel distance of less than the travel distance to the inner diameter of the bearing assembly 208) before an outer surface of the item of oilfield equipment 104 engages an inner surface of the equipment bracing portion 232. Therefore, the equipment bracing portion 232 of the guide 118 alleviates misalignment or prevents the lower stripper rubber 116B from excessive deformation caused by misalignment of the oilfield equipment 104. The sizing of the inner diameter of the guide 118 (including the inner diameter of equipment bracing portion 232) is determined according to a set of variables including but not limited to: (1) the size of the outer diameter of the piece of oilfield equipment 104 or larger diameter tool joints 206 in any particular application; (2) the inner diameter of the housing 108 or bearing assembly 208 in any particular application; (3) the axial length of the housing 108 or bearing assembly 208 in any particular application; and/or (4) the outer diameter of the stripper rubber 116 in any particular application.

The seal bracing portion 230 may be configured to surround the lower stripper rubber 116B and resist excessive deformation of the lower stripper rubber 116B due to oilfield equipment 104 misalignments and/or the larger diameter tool joints 206 passing through the lower stripper rubber 116B. As the upper and/or lower stripper rubber 116A/B deforms, the exterior side 202 of the upper and/or lower stripper rubber 116A/B may move radially toward the seal bracing portion 230 of the guide 118. Continued deformation of the upper and/or lower stripper rubber 116A/B may cause the exterior side 202 to partially, or completely, engage the seal bracing portion 230 of the guide 118. The seal bracing portion 230 of the guide 118 may prevent the oilfield equipment 104 from excessive deformation of the upper and/or lower stripper rubber 116A/B by limiting the total radial travel of the lower stripper rubber 116A/B.

The guide connector portion 234 is configured to couple the guide 118 to the lower seal coupler 228B. The guide connector portion 234 may take any suitable form so long as the guide 118 is secured to the bearing assembly 208 and/or the upper and/or lower stripper rubber 116A/B. Any suitable method may be used for coupling the guide 118 to the bearing assembly 208 including, but not limited to, bolts, pins, shear connectors, welding, and the like. If the guide 118 is removably coupled to the bearing assembly 208, for example with pins, the guide may be easily removed and replaced during RCD 114 maintenance. The guide connector portion 234 may be connected such that the guide 118 rotates with the bearing and the lower stripper rubber 116B, or such that it does not rotate with the bearing and the lower stripper rubber 116B (e.g. to the outer stationary portion of the bearing assembly 208).

Figure 3:
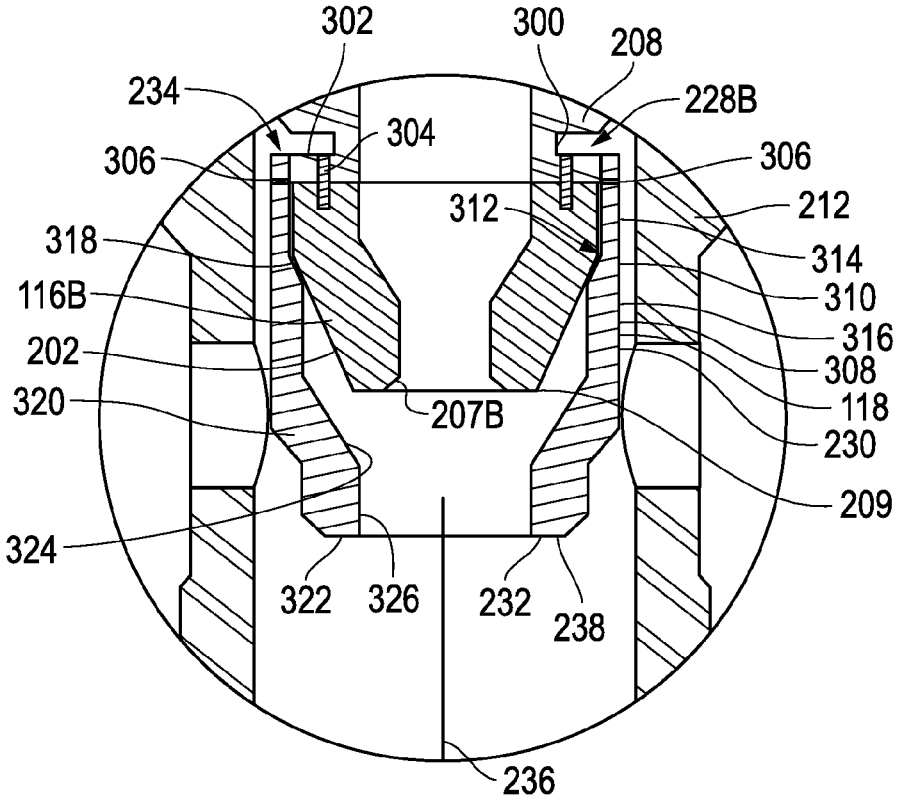
FIG. 3 depicts a cross sectional view of a portion of the RCD as shown in FIG. 2 proximate the lower stripper rubber according to an embodiment.

FIG. 3 depicts a cross sectional view of the RCD 114 shown in FIG. 2 proximate the lower stripper rubber 116B. As shown, the lower seal coupler 228B has a neck 300 and a shoulder 302. One or more fasteners 304 may couple the shoulder to the lower stripper rubber 116B. The fasteners 304 may be any suitable fastener for coupling the lower stripper rubber 116B to the bearing assembly 208 including, but not limited to, the seal fastener, bolts, screws, pins, and the like.

The outer surface of the shoulder 302 may be configured to engage and support the inner surface of the guide connector portion 234 of the guide 118. One or more guide fasteners 306 may couple the guide 118 to the shoulder 302. The guide fasteners 306 may prevent the guide 118 from moving relative to the bearing assembly 208. The guide fasteners 306 may be any suitable device including, but not limited to, the fasteners 304, splines, and the like.

The seal bracing portion 230 as shown is a cylindrical sleeve 308 configured to surround the perimeter of the lower stripper rubber 116B. The cylindrical sleeve 308 in the embodiment shown has a constant outer diameter 310 and an offset inner surface 312. The offset inner surface 312 is profiled to conform to and support the lower stripper rubber 116B (whilst being offset from the outer diameter of the lower stripper rubber 116B in the lower stripper rubber's 116B undeformed/undeflected state or position), and in the embodiment shown may have an upper portion 314 and a lower portion 316. The upper portion 314, as shown, has a larger inner diameter configured to engage and support the upper end of the lower stripper rubber 116B. The upper end of the lower stripper rubber 116B may be of larger outer diameter than the nose 207B of the lower stripper rubber 116B. Therefore, the increased inner diameter of the upper portion 314 of the seal bracing portion 230 allows the lower stripper rubber 116B to have a thickened or larger outer diameter portion and still be surrounded by the guide 118. The upper portion 314 may also constantly juxtapose and support/brace the lower stripper rubber 116B, thereby limiting the deflection of the lower stripper rubber 116B during oilfield operations.

In the embodiment shown a sloped/conical surface 318 may transition the offset inner surface 312 between the upper portion 314 and the lower portion 316. The sloped/conical surface 318 may allow the inner diameter to change without having sharp edges that could damage the lower stripper rubber 116B. The lower portion 316 of the offset inner surface 312 may have a smaller inner diameter than the upper portion 314. Therefore, the lower portion 316 may be closer to the exterior side 202 of the lower stripper rubber 116B toward the nose 207B. The lower portion 316 is configured to engage and limit the lower stripper rubber's 116B radial deformation as the oilfield equipment engages the lower stripper rubber 116B. As shown, the upper portion 314 and the lower portion 316 have a constant inner diameter; however, it should be appreciated that the upper portion 314 and/or the lower portion 316 may be shaped and/or contoured to match the exterior side 202 of the lower stripper rubber 116B.

In the embodiment shown the equipment bracing portion 232 of the guide 118 may have a transition portion 320 and an abutting portion 322. The transition portion 320, as shown, may have angled, or sloped/conical walls 324 that extend transversely toward the longitudinal axis 236. The abutting portion 322 has an abutting surface 326 configured to abut and guide the oilfield equipment 104. The abutting surface 326 may be a substantially cylindrical surface. The inner diameter defined at the abutting surface 326 is greater than the inner diameter of the undeflected lower stripper rubber 116B and greater than or equal to the inner diameter of the bearing assembly 208. In one embodiment the inner diameter defined at the abutting surface 326 is narrower than inner diameter of the seal bracing portion 230. The end 238 of the equipment bracing portion 232 extends at least as low as the distal end 209 of the nose 207B, and preferably the end 238 of the equipment bracing portion 232 projects beyond the distal end 209 of the nose 207B. In one example, the end 238 of the equipment bracing portion 232 projects one nose 207B length beyond the distal end 209 of the nose 207B.

Figure 4:
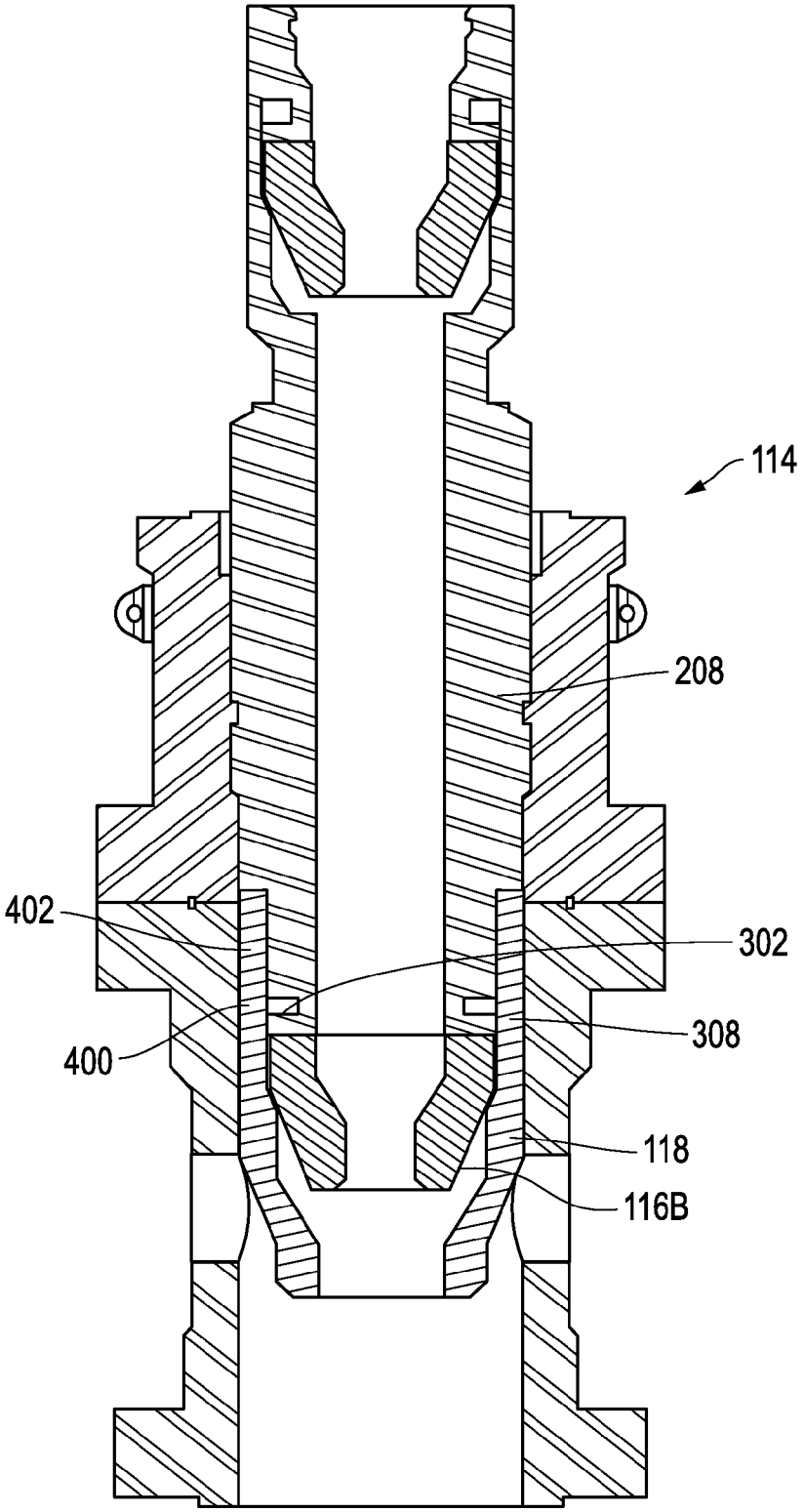
FIG. 4 depicts a cross-sectional view of an RCD according to an embodiment.

FIG. 4 depicts a cross-sectional view of the RCD 114 according to an embodiment. The guide 118 as shown has an alternate seal bracing portion 400. The seal bracing portion 230 and the equipment bracing portion 232 may be the same or similar as described above. The alternative seal bracing portion 400 may have one or more keys 402 for extending into and engaging the bearing assembly 208. The keys 402 engaging the bearing assembly 208 may increase the robustness of the connection between the guide 118 and the bearing assembly 208.

Figure 5:
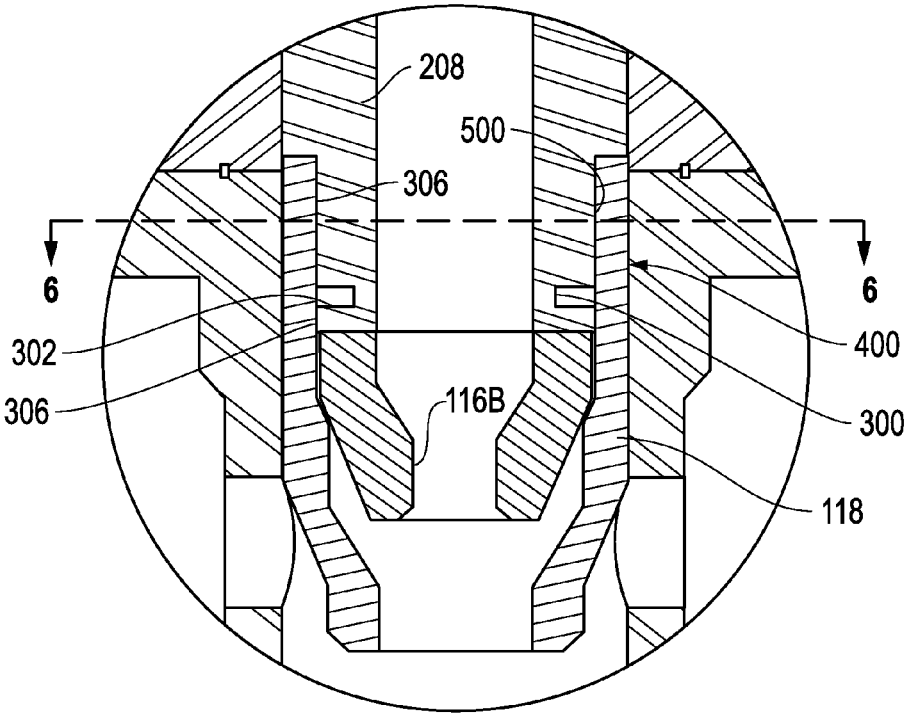
FIG. 5 depicts a cross sectional view of a portion of the RCD as shown in FIG. 4 proximate the lower stripper rubber according to an embodiment.

FIG. 5 depicts a cross sectional view of the RCD 114 shown in FIG. 4 proximate the lower stripper rubber 116B. As shown, the alternate seal bracing portion 400 may be substantially cylindrical proximate the shoulder 302 and into the neck 300. Above the neck 300 of the bearing 208, the alternate seal bracing portion 400 may have one or more of the keys 402 extending into one or more slots 500 formed in the bearing assembly 208. One or more of the guide fasteners 306 may couple the alternate seal bracing portion 400 to the shoulder 302 and/or the body of the bearing assembly 208.

Figure 6:
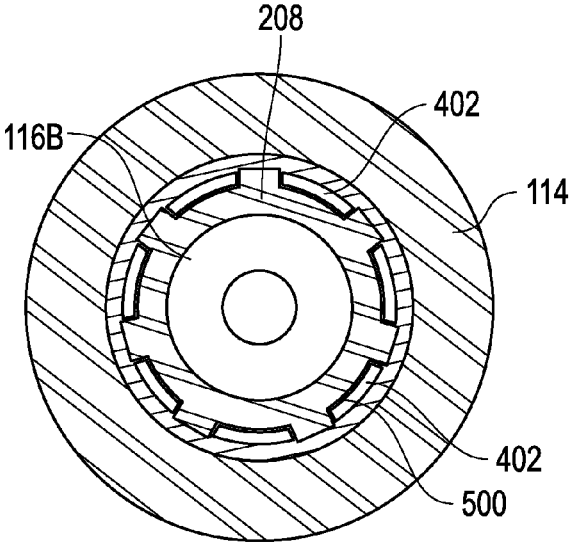
FIG. 6 depicts a cross-sectional view of a portion of the RCD shown in FIG. 5 according to an embodiment.

FIG. 6 depicts a cross sectional top view of the RCD 114 with the keys 402 secured in the slots 500 of the bearing 208. As shown, the outer perimeter of the bearing 208 has the slots 500 formed therein. During assembly, the lower stripper rubber 116B may be coupled to the shoulder 302. Then the keys 402 of the guide 118 may be moved into the slots 500. The alternate seal bracing portion 400 may then be coupled to the bearing using any suitable method including, but not limited to, the guide fasteners 306, and the like. Although the slots 500 are shown as being uncovered, or exposed, it should be appreciated that the slots may be covered, or enclosed. The enclosed slot would completely cover the keys 402 in the assembled position thereby reducing the risk of damage to the keys 402 as the bearing 208 rotates.

Although the guide 118 is shown in conjunction with the lower stripper rubber 116B located below the bearing assembly 208, it should be appreciated that the guide 118 may be used on a stripper rubber located above the bearing assembly 208 or located above the lower end of the bearing assembly 208. In one example, the stripper rubber 116A or b may be an inverted stripper rubber. The inverted stripper rubber may have a nose that points upward relative to the bearing 208 above the bearing assembly 208 or located above the lower end of the bearing assembly 208. In the inverted stripper rubber, the guide 118 would be similar to any of the guides 118 described herein, but would extend upward from the bearing 208 instead of downward.

FIG. 7 depicts another embodiment wherein the guide 118 is mounted above the housing 108 or bearing assembly 208 surrounding the upper stripper rubber 116A.

Figure 8:
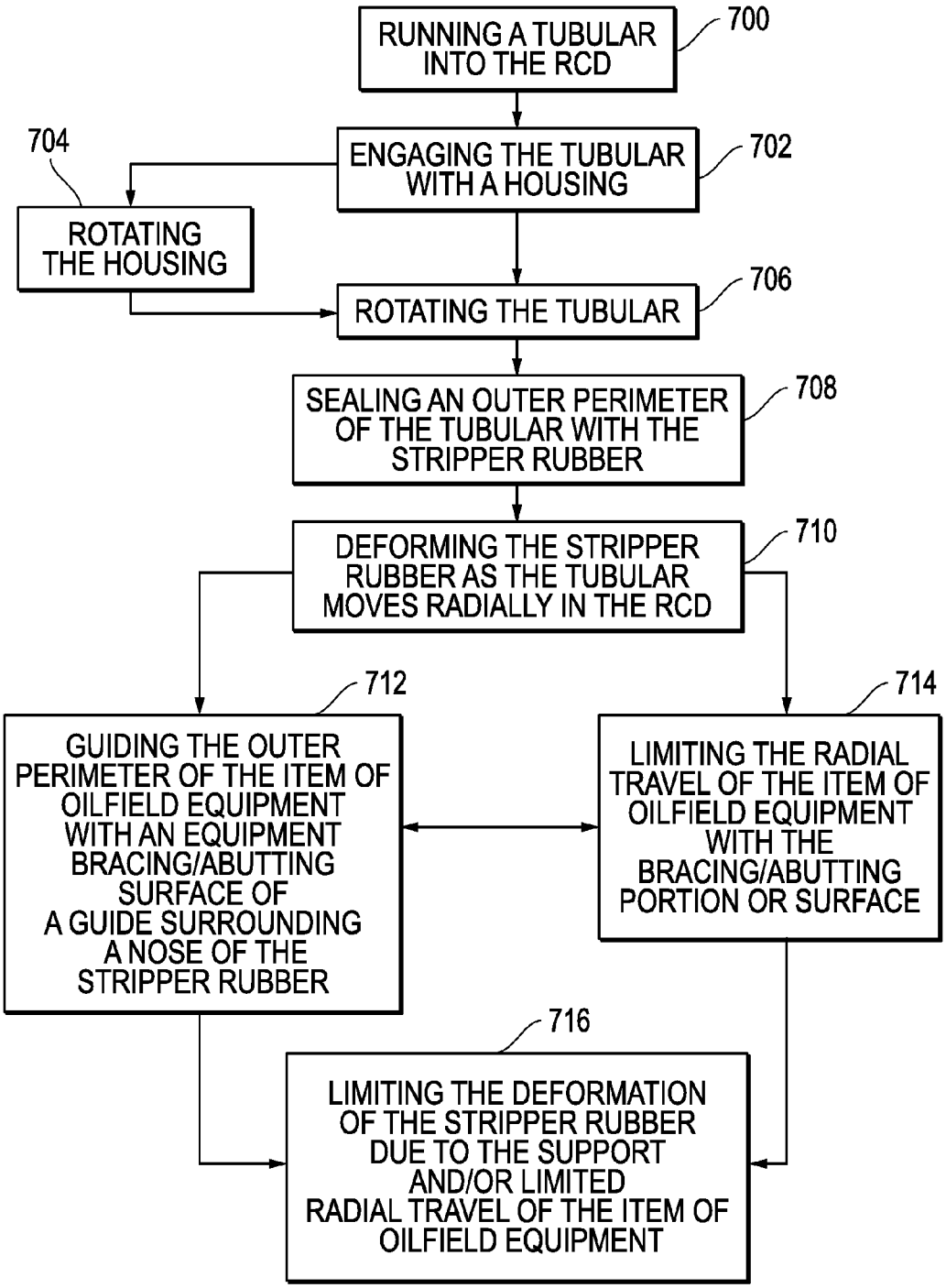
FIG. 8 depicts a method of guiding oilfield equipment within and/or through an RCD.

FIG. 8 depicts a method of limiting the deformation of the stripper rubber 116A/B in the RCD 114. The method begins at block 700 wherein the oilfield equipment 104, or tubular 125, is run into the wellbore 106 and into the RCD 114. The method continues at block 702 wherein the oilfield equipment 104, or tubular 125, is engaged by the bearing assembly 208 located in the RCD 114. The method optionally continues at block 704 wherein the housing 108 is optionally rotated as the oilfield equipment 104, or tubular 125, is rotated with the RCD 114; alternatively the method optionally continues at block 706 wherein the oilfield equipment 104 or tubular 125 is rotated. The method continues at block 708 wherein the outer perimeter of the oilfield equipment 104, or tubular 125, is sealed by a stripper rubber 116. The method continues at block 710 wherein the stripper rubber 116A/B is deformed by radial movement of the oilfield equipment 104, or tubular 125, within the RCD 114. The radial movement may be caused by misalignment of the oilfield equipment 104, or tubular 125, and/or the increased diameter of the tubular 125 for example at a tool joint (e.g. 206). The method optionally continues at block 712 wherein the outer perimeter of the item of oilfield equipment 104 is guided by the guide 118, wherein the equipment bracing portion 232 or the abutting surface 326 is surrounding the nose 207B of the lower stripper rubber 116B. The method optionally continues at block 714 wherein the radial travel of the item oilfield equipment 104 is supported and/or limited by interference from abutting the equipment bracing portion 232 or the abutting surface 326. The method continues at block 716 wherein the stripper rubber 116B is supported by and deformation of the stripper rubber 116B is limited due to the limited radial travel of the item of oilfield equipment 104.

Figure 9:
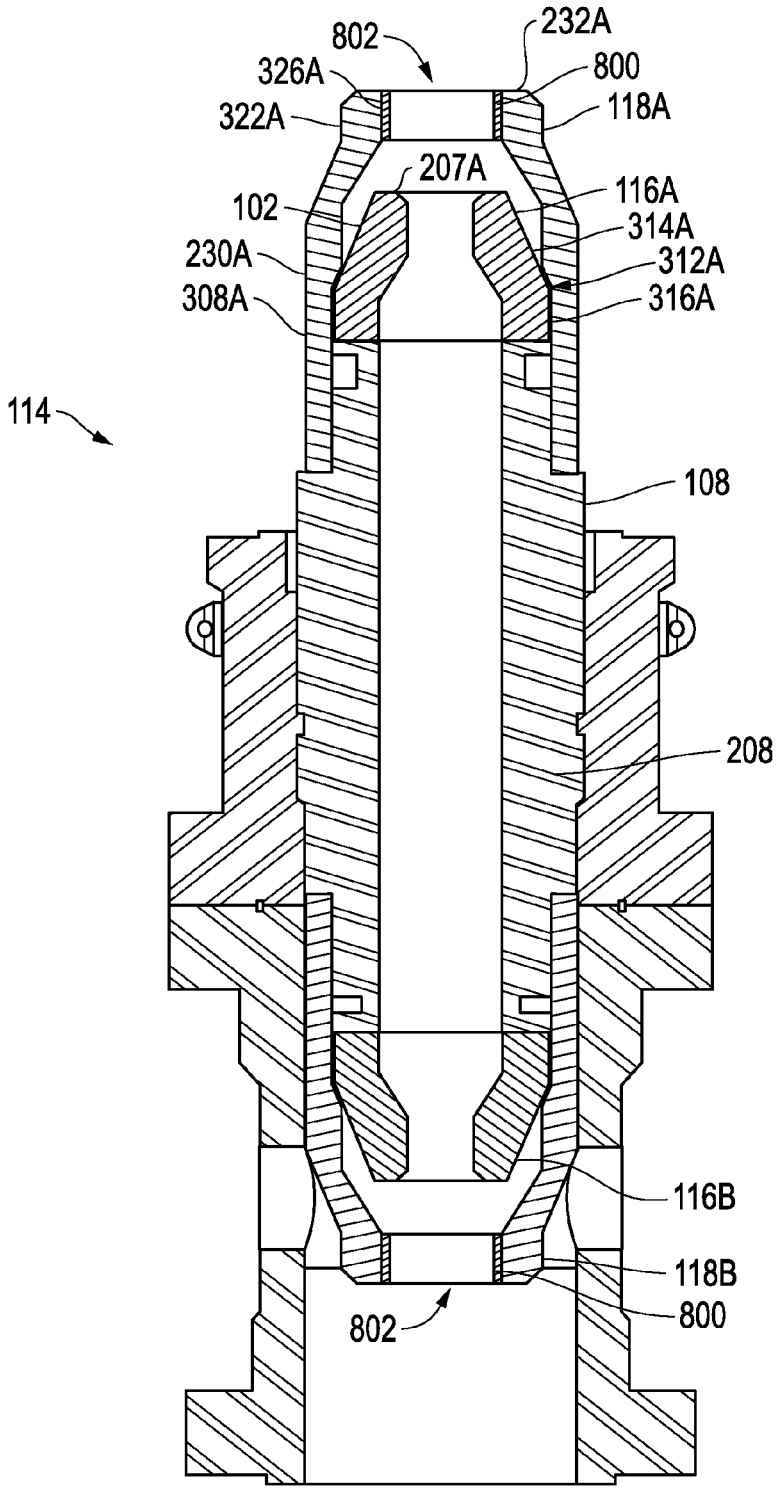
FIG. 9 depicts another embodiment wherein the guide is mounted above and below the housing or bearing assembly, and wherein the guide has a replaceable bushing in the inside diameter of the guide.
Figure 10:
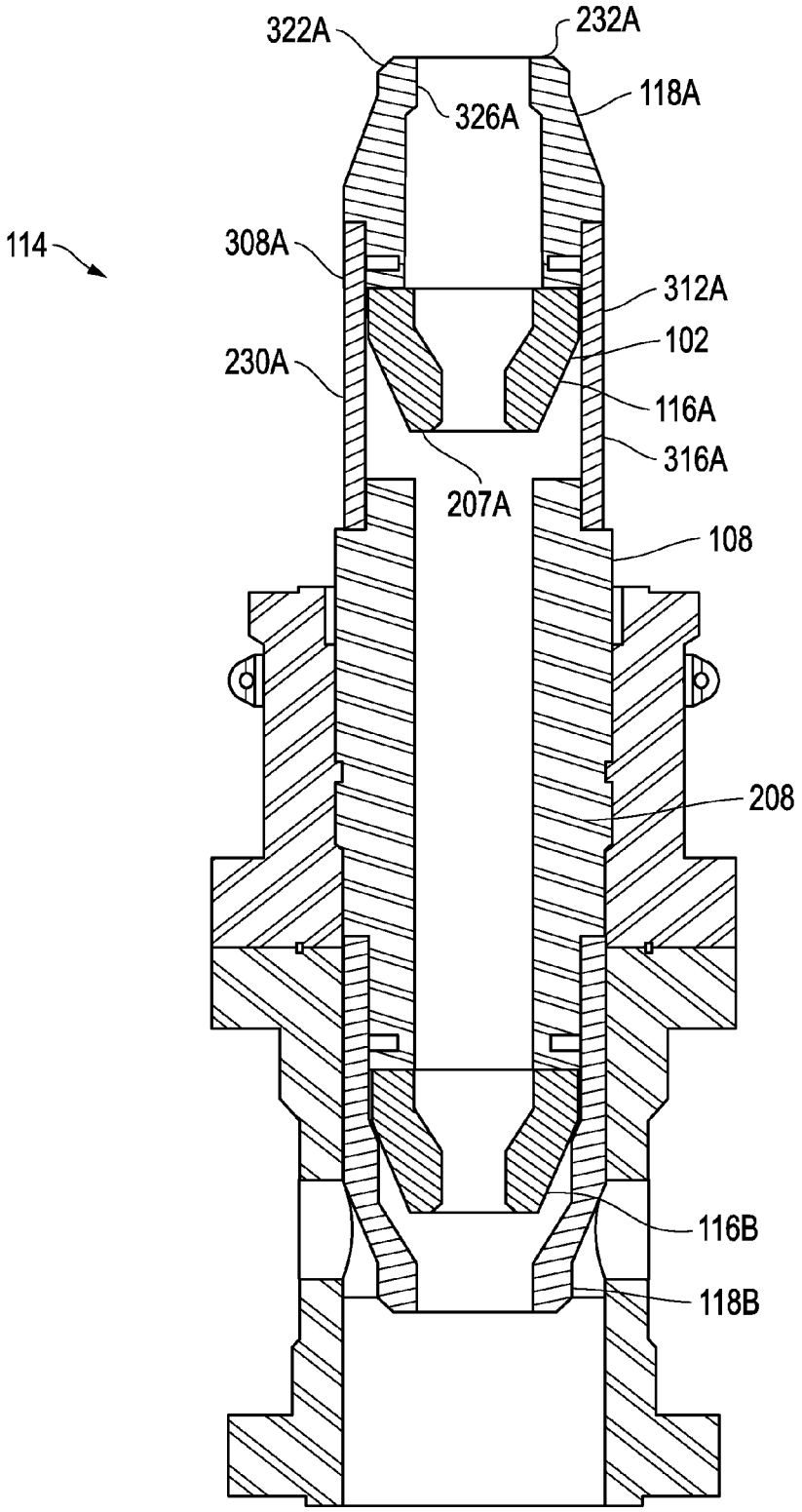
FIG. 10 depicts another embodiment wherein the guide is mounted above and below the housing or bearing assembly.
Figure 11:
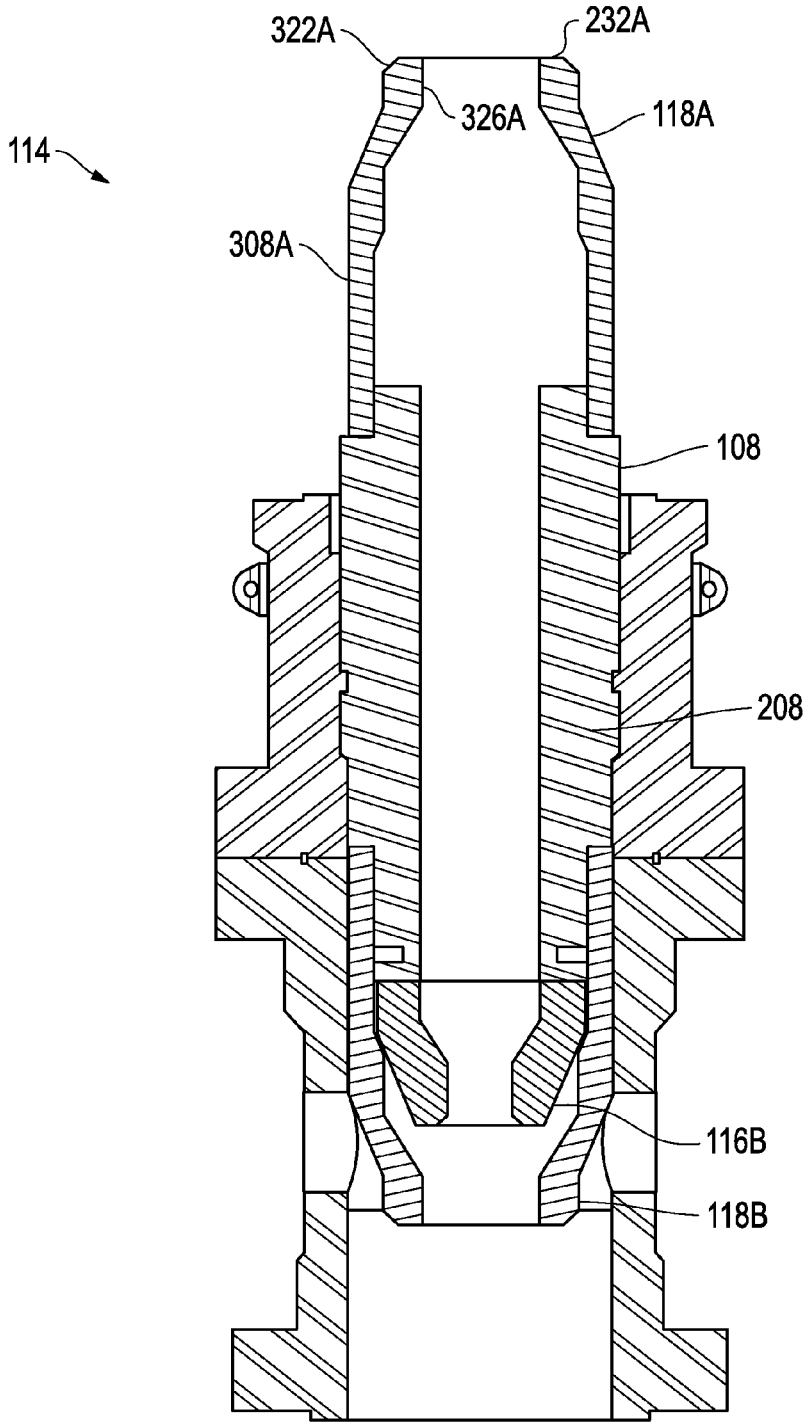
FIG. 11 depicts another embodiment wherein the guide is mounted above and below the housing or bearing assembly.

FIGS. 9-11 depict alternative embodiments of a pressure control apparatus with guides. These embodiments may feature a second guide 118A which is coupled proximate to another extremity portion of the housing 108. The second guide 118A is configured to support the seal element 102 during lateral deflection of the seal element 102 which may be created by movement of the item of oilfield equipment 104. Further the second guide 118A may also include an equipment bracing portion 232A, which is configured to guide the outer surface of the item of oilfield equipment 104, as the item of oilfield equipment 104 passes therethrough. The equipment bracing portion 232A has an abutting portion 322A with an abutting surface 326A. The inner diameter defined by abutting surface 326A is greater than the inner diameter of the seal element 102 and is greater than or equal to the inner diameter of the housing 108.

Other embodiments may feature a second seal element 102 coupled proximate to another extremity portion of the housing 108, where the second seal element 102 is configured to seal around the item of oilfield equipment 104. The second guide 118A coupled proximate to the second seal element 102 is configured to support the second seal element 102 during lateral deflection of the second seal element 102 that is created by movement of the item of oilfield equipment 104.

In addition, the second seal element 102 may be a stripper rubber 116A. The second guide 118A may feature a seal bracing portion 230A which is configured to laterally surround the stripper rubber 116A. The seal bracing portion 230A may also include a cylindrical sleeve 308A and the cylindrical sleeve 308A may have an offset inner surface 312A. The offset inner surface 312A has a lower portion 316A that is proximate to the housing 108 and an upper portion 314A laterally surrounding a nose 207A of the stripper rubber 116A. The inner diameter of the lower portion 316A of the cylindrical sleeve 308A is larger than the inner diameter of the upper portion 314A of the cylindrical sleeve 308A.

FIG. 9 depicts another embodiment similar to FIG. 7 having two guides 118A and 118B, and similar in that one guide 118B is mounted below the housing 108 or bearing assembly 208 surrounding the lower stripper rubber 116B, and another or second guide 118A is mounted above the housing 108 or bearing assembly 208 surrounding the upper stripper rubber 116A. However, the embodiment of FIG. 9 further has bushing(s) 800 mounted to the inner diameter of one of both of the abutting surfaces 326. The bushing(s) 800 are included for at least the purpose of limiting misalignment by narrowing the inside diameter of the guide(s) 118A and 118B. The opening 802 defined by each bushing 800 is slightly larger than the outer diameter of the piece of oilfield equipment 104 but, as shown, smaller than the opening to the guides 118A, 118B.

FIG. 10 depicts another embodiment similar to FIG. 7 having two guides 118A and 118B, and similar in that one guide 118B is mounted below the housing 108 or bearing assembly 208 surrounding the lower stripper rubber 116B, and another or second guide 118A is mounted above the housing 108 or bearing assembly 208 surrounding the upper stripper rubber 116A. However, the embodiment of FIG. 10 differs from the embodiment of FIG. 7 in that the upper stripper rubber 116A is facing downwardly (i.e. having a nose that points downward relative to the bearing 208) or in the same direction as the lower stripper rubber 116B.

FIG. 11 depicts another embodiment similar to FIG. 7 having two guides 118A and 118B, and similar in that one guide 118B is mounted below the housing 108 or bearing assembly 208 surrounding the lower stripper rubber 116B, and another or second guide 118A is mounted above the housing 108 or bearing assembly 208. However, the embodiment of FIG. 11 differs from the embodiment of FIG. 7 in that it excludes the upper stripper rubber 116A such that the embodiment includes only the lower stripper rubber 116B.

The embodiments described may also be used in non-rotating pressure control devices 112. In another embodiment, a guide 118 could be formed or configured without one or the other of a seal bracing portion 230 or an equipment bracing portion 232.

While the embodiments are described with reference to various implementations and exploitations, it will be understood that these embodiments are illustrative and that the scope of the inventive subject matter is not limited to them. Many variations, modifications, additions and improvements are possible. For example, the implementations and techniques used herein may be applied to any strippers, seals, or packer members at the wellsite, such as the BOP, and the like.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A pressure control apparatus, comprising:

a bearing assembly configured to engage an item of oilfield equipment being delivered through the oilfield pressure control apparatus, wherein the bearing assembly has an upper portion and a lower portion;

an upper stripper rubber coupled to the upper portion;

a lower stripper rubber coupled to the lower portion and configured to seal around the item of oilfield equipment;

a first misalignment limiter coupled proximate the lower stripper rubber, the first misalignment limiter configured to support the lower stripper rubber during lateral deflection of the lower stripper rubber created by movement of the item of oilfield equipment;

wherein the first misalignment limiter further comprises a first seal bracing portion configured to laterally surround the lower stripper rubber, wherein the first seal bracing portion comprises a first cylindrical sleeve;

wherein the first misalignment limiter further comprises a first equipment bracing portion configured to align an outer surface of the item of oilfield equipment as the item of oilfield equipment passes therethrough;

wherein the first equipment bracing portion comprises a first abutting portion having a first abutting surface, wherein an inner diameter defined by the first abutting surface is greater than an inner diameter of the lower stripper rubber and greater than or equal to an inner diameter of the bearing assembly; and wherein an end of the first equipment bracing portion projects beyond a distal end of a nose of the lower stripper rubber.

2. The pressure control apparatus according to claim 1, wherein the first cylindrical sleeve includes an offset inner surface, wherein the offset inner surface has an upper portion proximate the bearing assembly and a lower portion laterally surrounding the nose of the lower stripper rubber, and wherein an inner diameter of the upper portion is larger than an inner diameter of the lower portion.

3. The pressure control apparatus according to claim 2, wherein the offset inner surface comprises a conical surface transitioning from the upper portion to the lower portion.

4. The pressure control apparatus according to claim 3, wherein the first misalignment limiter has at least one key configured to extend into at least one slot defined in the bearing assembly.

5. The pressure control apparatus according to claim 1, further comprising:

a second misalignment limiter coupled proximate the upper stripper rubber, the second misalignment limiter configured to support the upper stripper rubber during lateral deflection of the upper stripper rubber created by movement of the item of oilfield equipment;

wherein the second misalignment limiter further comprises a second seal bracing portion configured to laterally surround the upper stripper rubber, wherein the second seal bracing portion comprises a second cylindrical sleeve;

wherein the second misalignment limiter further comprises a second equipment bracing portion configured to align the outer surface of the item of oilfield equipment as the item of oilfield equipment passes therethrough;

wherein the second equipment bracing portion comprises a second abutting portion having a second abutting surface, wherein an inner diameter defined by the second abutting surface is greater than an inner diameter of the upper stripper rubber and greater than or equal to the inner diameter of the bearing assembly; and wherein an end of the second equipment bracing portion projects beyond a distal end of a nose of the upper stripper rubber.

6. The pressure control apparatus according to claim 5, further comprising a first bushing mounted to the inner diameter defined by the first abutting surface, and a second bushing mounted to the inner diameter defined by the second abutting surface.

* * * * *